United States Patent [19]

Moriyama et al.

[11] Patent Number: 5,015,811

[45] Date of Patent: May 14, 1991

[54] SNAP-ACTION PUSHBUTTON SWITCH WITH CLICK SOUND

[75] Inventors: Hiroyuki Moriyama; Kenshi Nagata, both of Tottori, Japan

[73] Assignee: Omron Tateisi Electronics Co., Kyoto, Japan

[21] Appl. No.: 365,449

[22] Filed: Jun. 13, 1989

[30] Foreign Application Priority Data

Jun. 30, 1988 [JP] Japan ..... 63-162978

[51] Int. Cl.[5] ..... H01H 9/00

[52] U.S. Cl. ..... 200/521; 200/308

[58] Field of Search ..... 200/521, 533, 308, 341, 200/447, 449, 450, 435

[56] References Cited

U.S. PATENT DOCUMENTS 1,194,243 8/1916 Schultze ..... 200/435

3,187,133 6/1965 Pierce ..... 200/435

*Primary Examiner*—Renee S. Luebke

*Attorney, Agent, or Firm*—Fish & Richardson

[57] ABSTRACT

This invention provides a pushbutton switch which produces a click sound, the loudness of which is easily variable. In response to the vertical movement of operating cams of a pushbutton, a plate spring moves up and down. The moment when the edge of the operating cams trips over click spring portions of the plate spring, a force is applied to the plate spring so that the plate spring hits the inner top wall or bottom wall of a housing. In this manner, the pushbutton switch provides both a snap feeling and a click sound.

5 Claims, 6 Drawing Sheets

SNAP-ACTION PUSHBUTTON SWITCH WITH CLICK SOUND

BACKGROUND OF THE INVENTION

1. Field of the Invention

This invention relates to a pushbutton switch, and more particularly to a pushbutton switch for use on keyboards of electronic typewriters, word processors, computer terminal units or the like, which produce a snap feeling and a click sound.

2. Related Art

In order that a pushbutton switch for electronic typewriters and other machines may be easy for the operator to manipulate with reduced fatigue, the switch preferably produces a click or snap feeling and a click sound when pressed. As an example of a known pushbutton switch adapted to give such a snap feeling and a click sound, there is the device disclosed in Japanese laid-open Utility Model Application No. 19928/1986.

Thus, as shown in FIGS. 7 and 8, this pushbutton switch comprises a housing 1, a pushbutton 2 accommodated in said housing 1 in such a manner that it can be vertically movable within and with respect to said housing 1, a switch element 3 which is disposed within said housing 1 and which responds to the vertical movement of said pushbutton 2, and a plate spring 4 which is disposed in said housing 1 and adapted to produce a feeling and a click sound in response to the vertical movement of said pushbutton 2.

As the pushbutton 2 is depressed, it presses an arm portion 4*a* extending from the top of said plate spring 4, whereupon a bend portion 4*b* of said plate spring 4 is displaced away from an inner lateral wall 1*a* of said housing 1 toward the pushbutton 2 until the bend portion 4*b* hits a projection 1*b* of housing 1 to produce a click sound. In the course, a pressure plate spring 5 is also pressed but does not yet actuate the switch element 3. As the pushbutton 2 is further depressed, it rides on a tip portion 4*c* of the arm 4*a* of said plate spring 4 to thereby produce a click or snap feeling. Furthermore, the pushbutton 2 presses the tip portion 4*c* of plate spring 4 in a transverse direction to let the plate spring 4 return to the inner lateral side 1*a* of housing 1, whereupon a click sound is produced. At the same time, the pushbutton 2 actuates the switch element 3 through the pressure spring 5. The pushbutton 2 is biased by a coil spring 6 in a release direction (toward the upper position).

In this switch construction, as the pushbutton 2 is depressed, the plate spring 4 is flexed to cause its bend portion 4*b* to hit the lateral wall 1*a* of the housing 1 and the projection 1*b* to thereby produce click sounds. However, since the amount of flexure of the plate spring 4 is fixed, the loudness of the click sound cannot be varied, even though it is desirable to vary the loudness of kinds of switches.

SUMMARY OF THE INVENTION

It is an object of this invention to provide a pushbutton switch whose click sound level can be easily varied. Other objects and advantages of this invention will become apparent as the following description proceeds.

The pushbutton switch of this invention comprises a housing, a pushbutton which is disposed within the housing in such a manner that it can reciprocate in a vertical direction and is biased in a release direction, a switch element which is disposed within the housing and is actuated in response to the vertical movement of said pushbutton, and click means which is disposed within the housing and adapted to produce a snap feeling and a click sound in response to the vertical movement of the pushbutton. The click means comprises an operating cam which moves vertically with the pushbutton as a unit and a plate spring having an upright portion adapted to move vertically along the inner lateral wall of the housing, with the vertical movement thereof being limited by abutment against the inner top and bottom walls of the housing. A click spring portion extends into the range of reciprocating motion of the operating cam, the pushbutton being vertically movable over a range greater than that of the plate spring. The operating cam and the plate spring are movable together in engagement, so that when the operating cam trips over the click spring portion, a resilient force acting in the direction from the operating cam portion to the inner top wall or bottom wall of the housing is imparted to the plate spring resilient force acting in the direction from the operating cam portion to the inner top wall or bottom wall of the housing.

BRIEF DESCRIPTION OF THE DRAWINGS

The above and other objects, advantages and features of this invention will be more fully understood and appreciated when considered in conjunction with the accompanying drawings, wherein.

DETAILED DESCRIPTION OF THE PREFERRED EMBODIMENTS

Figure 1:
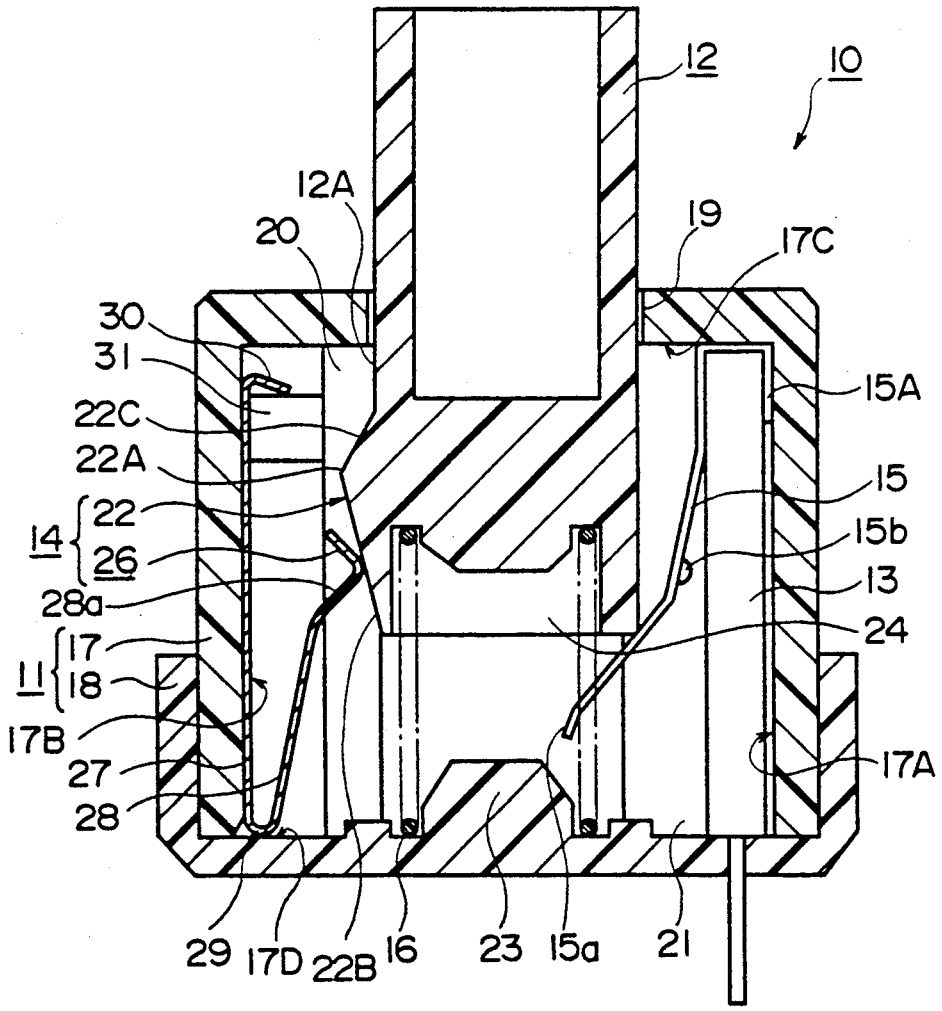
FIG. 1 is a longitudinal sectional view showing a pushbutton switch according to an embodiment of this invention in a condition prior to depressing.

The preferred embodiments of this invention are described in detail below with references to the accompanying drawings.

Referring to FIGS. 1 through 4 showing a preferred embodiment of this invention, the pushbutton switch of this invention, indicated at 10, comprises a housing 11, a pushbutton 12, a switch mechanism 13, a click means 14, a pressure spring 15 and a release spring 16.

The housing 11 comprises an upper case 17 and a lower case 18, both of which are generally box-shaped, with the upper case 17 being dimensioned to fit into the open space of the lower case 18. After the internal component parts, including the pushbutton 12, are built into the upper case 17, the lower case 18 is mated with the upper case 17, for example by a snap-in means (not shown).

The pushbutton 12 is inserted into a hole 19 provided in the upper case 17 and is supported so as to be vertically movable by means of pairs of projections 20, 20 and 21, 21 disposed on the inner sides of the opposite lateral walls of the top case 17. The pushbutton 12 is provided with a pair of operating cams 22 formed on the lateral sides 12A facing said pair of projections 20, 20. The operating cam 22 has a ridge 22A in the central portion thereof to define inclined surfaces 22B and 22C. The cam 22 is disposed as projecting between the pair of projections 20, 20 toward the inner side 17B of the lateral wall of the upper case 17 and is biased upwardly at all times by the release spring 16 interposed between the pushbutton 12 and the lower case 18. This release spring 16 is constituted by a coil spring and its tip is accommodated in, and positioned by, a recess 24 formed in the bottom of said pushbutton 12, while its lower end is engaged and positioned by a projection 23 formed on the center of the bottom wall of the lower case 18.

The switch mechanism 13 is accommodated between the projections 21, 21 of the upper case 17 and the inner surface 17A of the lateral wall of the upper case 17. The pressure spring 15 is interposed between this switch mechanism 13 and the pushbutton 12. The top end 15A of the pressure spring 15 is supported by and between the switch mechanism 13 and upper case 17, with the bottom end **15*a* slanting inwardly into the range of reciprocating movement of the pushbutton 12 which lies below the position of the pushbutton 12** prior to depressing.

The plate spring 26, together with said operating cam 22, constitutes the click mechanism 14. As illustrated in detail in FIG. 3, this plate spring 26 has an upright portion 27, a pair of click spring portions 28 extending toward the front from the upright portion 27 through respective bottom bends 29, and a bend 30 extending approximately at ,a right angle as illustrated relative to the upright portion 27. Furthermore, said upright portion 27 has lateral portions 31, each of which is bent approximately at right angles toward the front. The plate spring 26 is loosely mounted between the pair of projection 20, 20 of the upper case 17 and the inner side 17B of the lateral wall in such a manner that it can move vertically as its lateral portions 31 are guided by and between them. In this loosely fitted condition, the top bends **28*a* of the click spring portions 28 are abutted against the lateral wall 12A of the pushbutton 12**.

Figure 2:
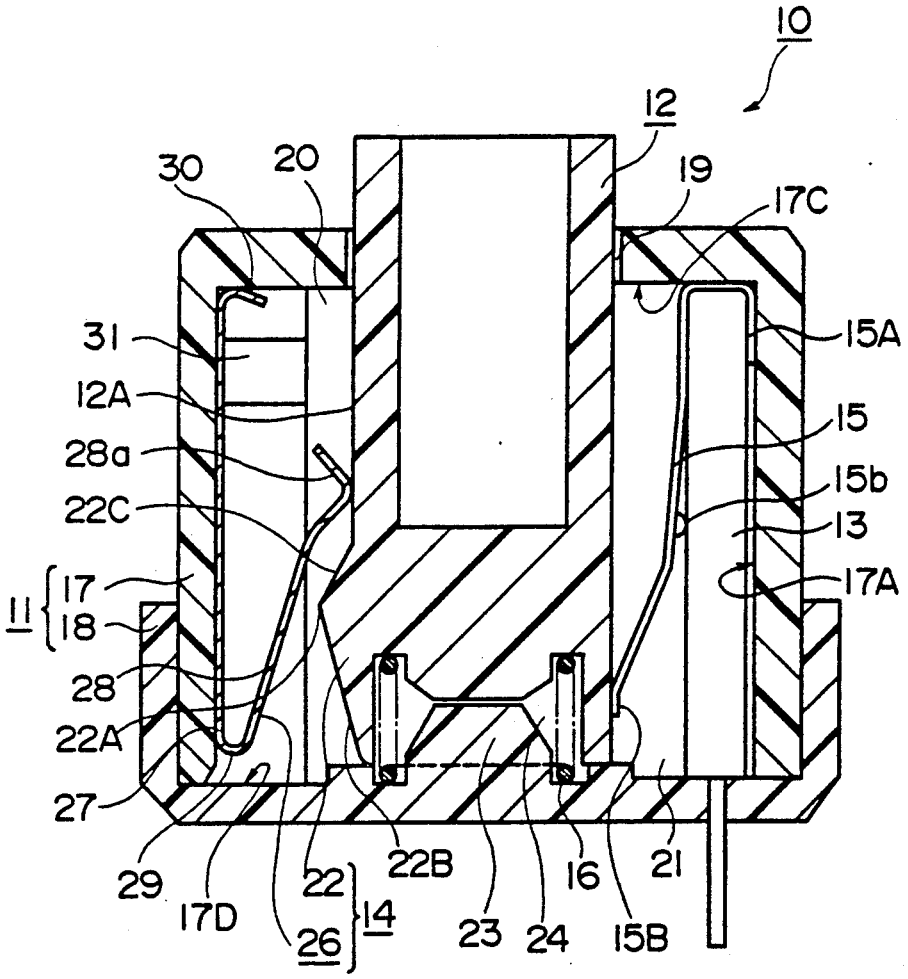
FIG. 2 is a longitudinal sectional view showing the pushbutton switch of FIG. 1 in the depressed condition.
Figure 3:
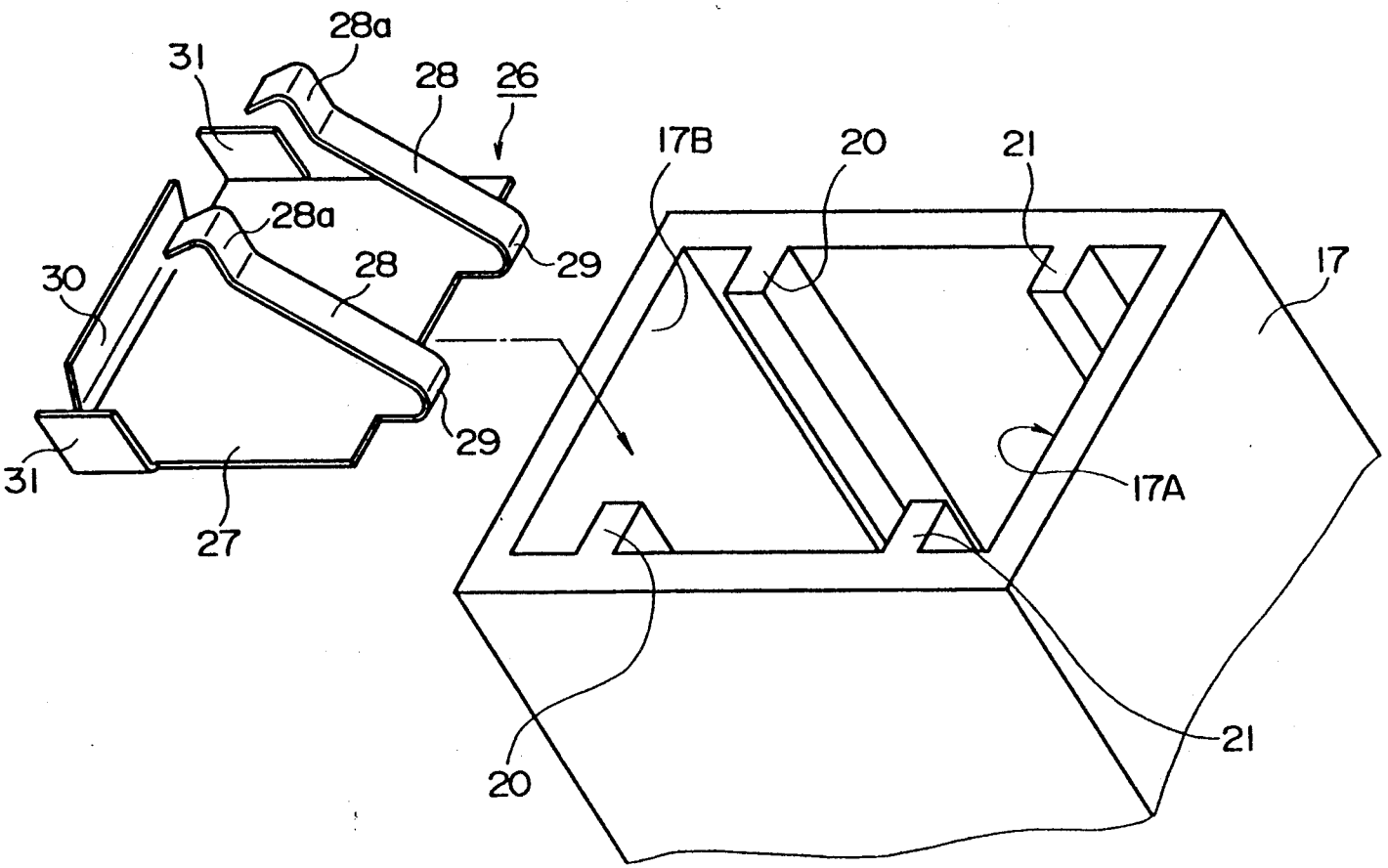
FIG. 3 is a partial perspective disassembled view of the pushbutton switch illustrated in FIG. 1.
Figure 4A:
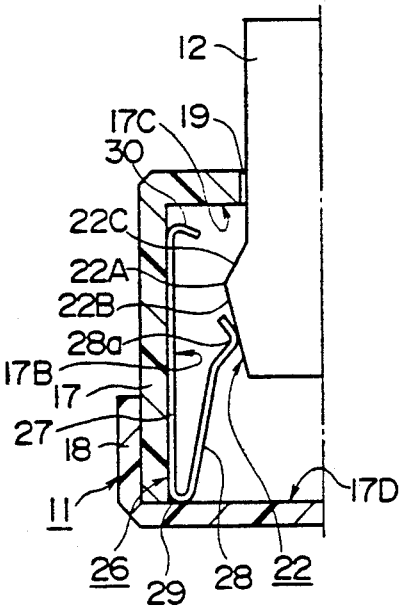
FIG. 4 is a series of views showing the operation of the pushbutton switch of FIG. 1.
Figure 4B:
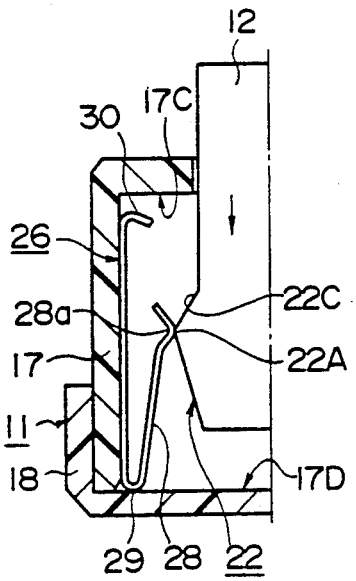
Figure 4C:
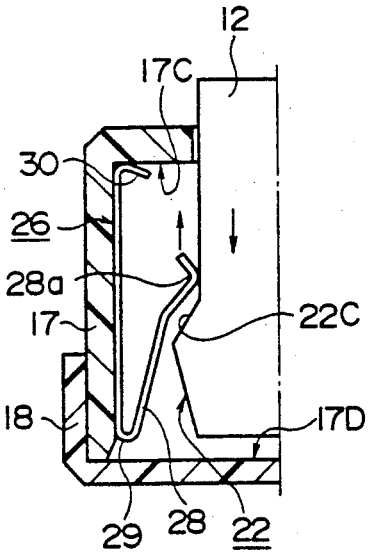
Figure 4D:
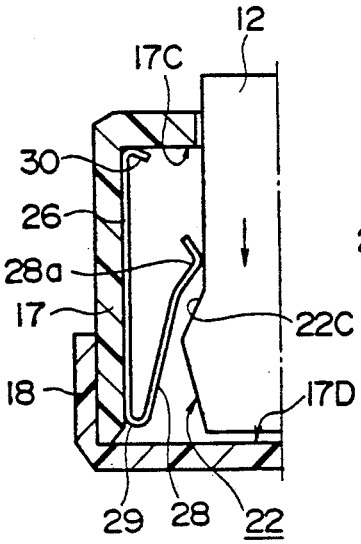
Figure 4E:
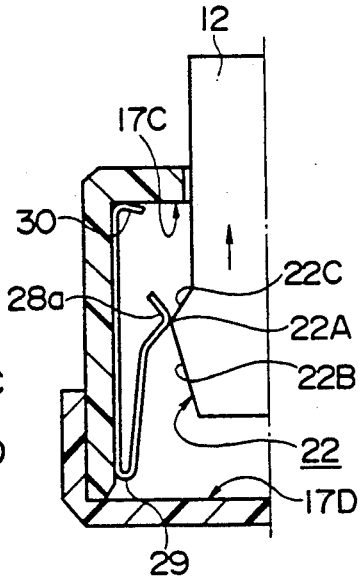
Figure 4F:
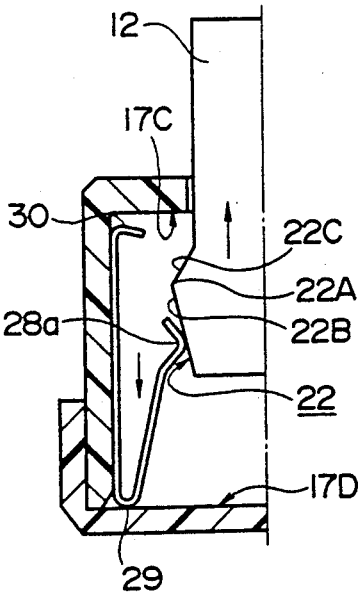

Operation of the pushbutton switch thus constructed is explained with reference to FIGS. 1, 2 and 4.

First, prior to depressing the pushbutton 12, the operating cam 22 is in the uppermost position beyond the top bend **28*a* of the click spring portion 28. The plate spring 26 is positioned with its bottom bend 29 abutted against the inner bottom wall of the lower case 18, while the top bend 28*a* of the click spring portion 28 is abutted against the inclined surface 22B so that the whole plate spring 26 is displaced downward. On the other hand, the pressure spring 15 is in a condition such that its top end 15*a* invades far into the range of reciprocating movement of the pushbutton 12, with the projection 15*b* being held away from the switch mechanism 13. This condition is shown in FIG. 1 and FIG. 4**(*a*).

Then upon depression, the pushbutton 12 is displaced downward 14 as the inclined surface 22B of the operating cam 22 slides against the plate spring 26. In response, the click spring portion 28 of the plate spring 26 is displaced toward the inner lateral wall 17B as illustrated in FIG. 4(*b*). Until, the top bend **28*a* of the click spring portion 28 reaches the ridge 22A, the plate spring 26 is subject to a pressing force acting downward from the pushbutton 12** side.

As the pushbutton 12 is further depressed and the ridge 22A trips over the top bend **28*a* of the click spring portion 28, the plate spring 26 is released as the downward pressing force is instantly relieved by the inclined surface 22C, whereby a feeling is obtained. At the same time, the plate spring 26 is abruptly pushed upward along the inclined surface 22C and the top bend 30 of the plate spring 26 hits the top inner wall 17C as illustrated in FIG. 4**(*c*) to produce a click sound. At the same time, the tip **15*a* of the pressure spring 15 is pressed outwardly by the bottom angular portion of the pushbutton 12 so that the projection 15*b* actuates the switch mechanism 13. And as the pushbutton 12 is further depressed until its bottom hits the inner bottom wall 17D, this position corresponds to the maximum stroke of the pushbutton 12. This state is illustrated in FIG. 2 and FIG. 4**(*d*).

Then, as the depressing force on the pushbutton 12 is released, the pushbutton 12 is displaced upward by the resilient force of the release spring 16. Thus, as illustrated in FIG. 4(*e*), the ridge 22A of the operating cam 22 of the pushbutton 12 reaches the top bend **28*a* of the click spring portion 28. Beyond this top bend 28*a*, the plate spring 26 is released as the upward pressing force is instantly relieved by the inclined surface 22B as illustrated in FIG. 4**(*f*) to produce a "snap" feeling. At the same time, the bottom bend 29 hits the inner bottom wall 17D to produce a click sound. The pressing force exerted on the switch mechanism 13 by the pressure spring 15 is released at the same time. In this manner, the top bend **28*a* of the click spring portion 28 is positioned on the lower side of the operating cam 22, i.e. said inclined surface 22B, so as to return to the original condition illustrated in FIG. 1 and FIG. 4**(*a*).

Thus, in this pushbutton switch, the vertical movement of the pushbutton 12 is accompanied by the vertical movement of the plate spring 26. Moreover, the operating cam 22 is larger than the click spring portions 28 and movable. When the operating cam 22 trips over the top bends **28*a* of the click spring portions 28, a resilient force is applied to the plate spring 26 by the operating cam 22 and this resilient force causes the plate spring 26 to abruptly move upward 14 or downward 14 to hit the top inner wall 17C or inner bottom wall 17D, producing both a click sound and a snap feeling. Furthermore, by varying the vertical dimension of the plate spring 26, that is the distance from the top bend 30 to the bottom bend 29, the distance of movement to the inner top wall 17C or inner bottom wall 17D can be varied so that an optimal loudness of the click sound can be obtained. Therefore, the click sound level can be easily adjusted by changing the vertical length of the plate spring 26**.

Figure 5:
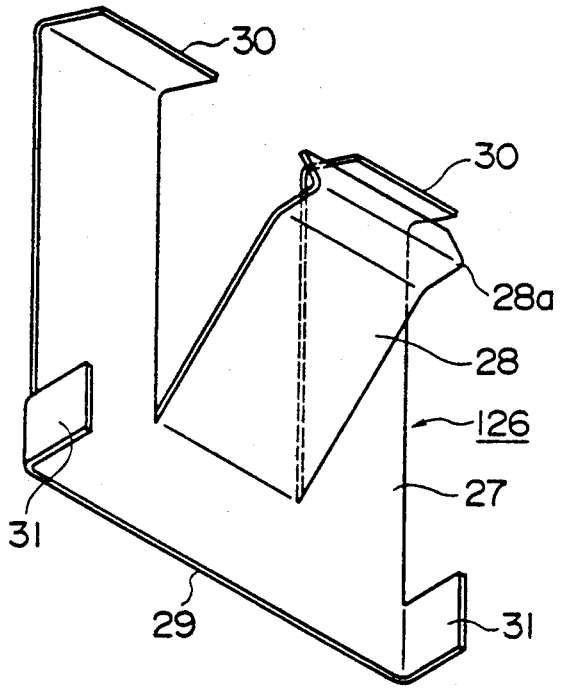
FIG. 5 is a perspective view showing a modification of the plate spring in the pushbutton switch of FIG. 1.
Figure 6:
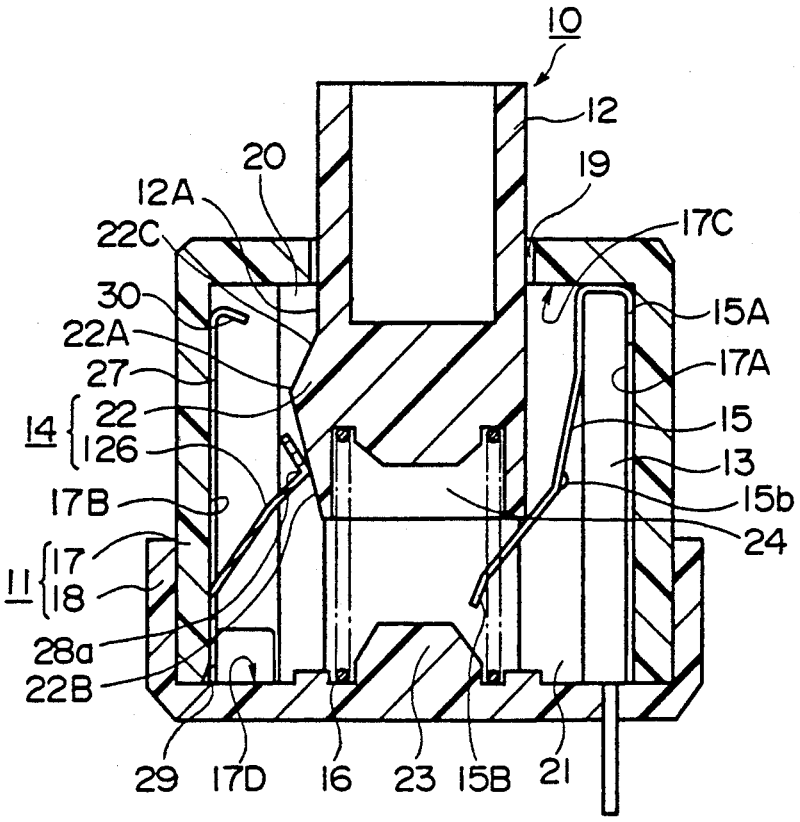
FIG. 6 is a longitudinal sectional view of a switch incorporating the plate spring of FIG. 5.
Figure 7:
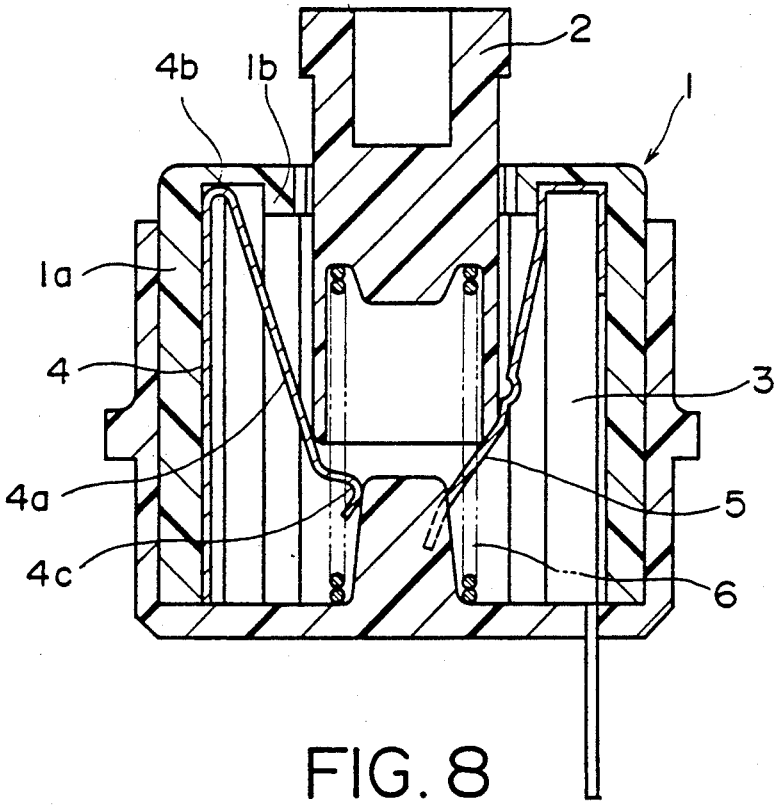
FIG. 7 PRIOR ART
FIG. 7 is a longitudinal sectional view showing the prior art pushbutton switch in a condition prior to depressing.
Figure 8:
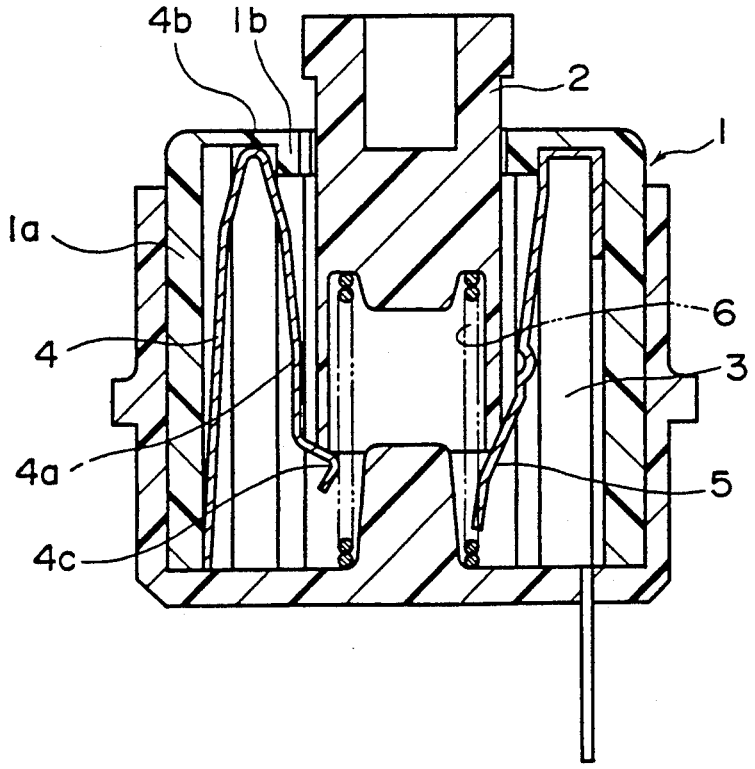
FIG. 8 PRIOR ART
FIG. 8 is a longitudinal section view showing the pushbutton switch of FIG. 7 in the depressed condition.

Another embodiment of this invention is described below with reference to FIG. 5. It should be understood that like numerals are used to represent like parts or positions. Whereas the plate spring 26 in the preceding embodiment has click spring portions 28 bent back from the bottom of the upright portion 27, the plate spring 26 of this embodiment has click spring portions 28 formed by raising along incisions made from its top edge. As shown in FIG. 6, this plate spring 26 is loosely fitted between a pair of projections 20, 20 of the upper case 17 and the inner lateral wall 17B in such a manner that it can move vertically as its lateral portions 31 are guided between them. The top bend **28*a* of the click spring portion 28 is disposed in abutment against the lateral side 12A of the pushbutton 12**. The rest of the operations of the switch is more or less the same as that to the first embodiment.

It should be understood that while the switch mechanism 13 in each of the above embodiments is actuated through the pressure spring 15, the present invention is not limited to such a switch mechanism driven by a pressure spring but may use other switching systems.

The above description and the accompanying drawings are merely illustrative of the application of the principles of the present invention and are not limiting. Numerous other arrangements which embody the principles of the invention and which fall within its spirit and scope may be readily devised by those skilled in the art. Accordingly, the invention is not limited by the foregoing description, but is only limited by the scope of the appended claims.

What is claimed is:

1. A pushbutton switch comprising:

a housing, said housing having an inner lateral wall, an inner top wall and an inner bottom wall;

a pushbutton disposed within said housing such that the pushbutton can reciprocate in a vertical direction, said pushbutton being biased in a release direction;

a switch mechanism disposed within said housing, said switch mechanism being actuated in response to the vertical movement of said pushbutton; and click means disposed within said housing for producing a snap feeling and a click sound in response to the vertical movement of said pushbutton, said click means comprising:

an operating cam which is reciprocatably movable in a vertical direction along a predetermined path with said pushbutton, said a plate spring which can move vertically within said housing, the vertical movement of the plate spring being limited by abutment against the inner top and bottom walls of said housing, said plate spring having an upright portion which contacts the inner lateral wall of the housing and a click spring portion extending into the predetermined path of reciprocating motion of said operating cam, wherein said pushbutton can move vertically over a range greater than can said plate spring;

wherein when said pushbutton is operated so that said operating cam trips over said click portion, a resilient force acting in a direction from said operating cam to either said inner top wall or inner bottom wall of said housing is imparted to the plate spring; and wherein said housing comprises a first compartment which houses said plate spring and a second compartment which houses said switch mechanism.

2. The pushbutton switch of claim 1, wherein said operating cam comprises a lateral wall of said pushbutton, said lateral wall having two surfaces which are angled with respect to each other.

3. The pushbutton switch of claim 1, wherein said click spring portion is located at lower end portions of said upright portion which are bent.

4. The pushbutton switch of claim 1, wherein said click spring portion is located at a central portion of said upright portion which is raised from said upright portion.

5. A push-button switch comprising:

a housing, said housing having an inner lateral wall, an inner top wall and an inner bottom wall;

a pushbutton disposed within said housing such that the pushbutton can reciprocate in a vertical direction, said pushbutton being biased in a release direction;

a switch mechanism disposed within said housing, said switch mechanism being actuated in response to the vertical movement of said pushbutton; and click means disposed within said housing for producing a snap feeling and a click sound in response to the vertical movement of said pushbutton, said click means comprising:

an operating cam which is reciprocatably movable in a vertical direction along a predetermined path with said pushbutton, and a plate spring which can move vertically within said housing, the vertical movement of the plate spring being limited by abutment against the inner top and bottom walls of said housing, said plate spring having an upright portion formed of a predetermined length which extends vertically and contacts the inner lateral wall of the housing and a click spring portion extending into the predetermined path of reciprocating motion of said operating cam, wherein said pushbutton can move vertically over a range greater than can said plate spring;

wherein when said pushbutton is operated so that said operating cam trips over said click portion, a resilient force acting in a direction from said operating cam to either said inner top wall or inner bottom wall of said housing is imparted to the plate spring, and wherein a different click sound can be provided by using a plate spring having an upright portion of a different predetermined length.

* * * * *